United States Patent [19]

Simon

[11] 4,441,404

[45] Apr. 10, 1984

[54] VENTILATION APPARATUS

[75] Inventor: Johnathan G. Simon, Great Torrington, England

[73] Assignee: R. W. Simon Limited, North Devon, England

[21] Appl. No.: 501,970

[22] Filed: Jun. 13, 1983

Related U.S. Application Data

[63] Continuation of Ser. No. 319,937, Nov. 10, 1981, abandoned.

[51] Int. Cl.[3] ..... E06B 7/02

[52] U.S. Cl. ..... 98/96; 98/39; 98/43 R; 98/94 R; 98/118

[58] Field of Search ..... 98/33 R, 39, 43 R, 88 R, 98/94 R, 96, 118

[56] References Cited

U.S. PATENT DOCUMENTS

| | | | |
|---|---|---|---|
| 2,048,985 | 7/1936 | Akester | 98/39 X |
| 2,153,576 | 4/1939 | Kurth et al. | 98/96 X |
| 3,648,591 | 3/1972 | Winnett | 98/39 |
| 3,895,568 | 7/1975 | Stone | 98/43 R |

FOREIGN PATENT DOCUMENTS

| | | | |
|---|---|---|---|
| 1210539 | 2/1966 | Fed. Rep. of Germany | 98/96 |
| 268472 | 10/1929 | Italy | 98/118 |
| 476724 | 12/1937 | United Kingdom | 98/39 |

*Primary Examiner*—Edward G. Favors
*Assistant Examiner*—Harold Joyce
*Attorney, Agent, or Firm*—James E. Nilles

[57] ABSTRACT

Ventilating apparatus suitable for use with double glazed panels comprises an elongate cylindrical member having an outwardly circumferentially extending flange and adapted to receive removably a ventilating component therein and an annular member thereon. The cylindrical member extends through apertures in the panels and the flange and annular member are adhesively secured to adjacent panels thereby to seal the cylindrical member relative to the panels.

2 Claims, 1 Drawing Figure

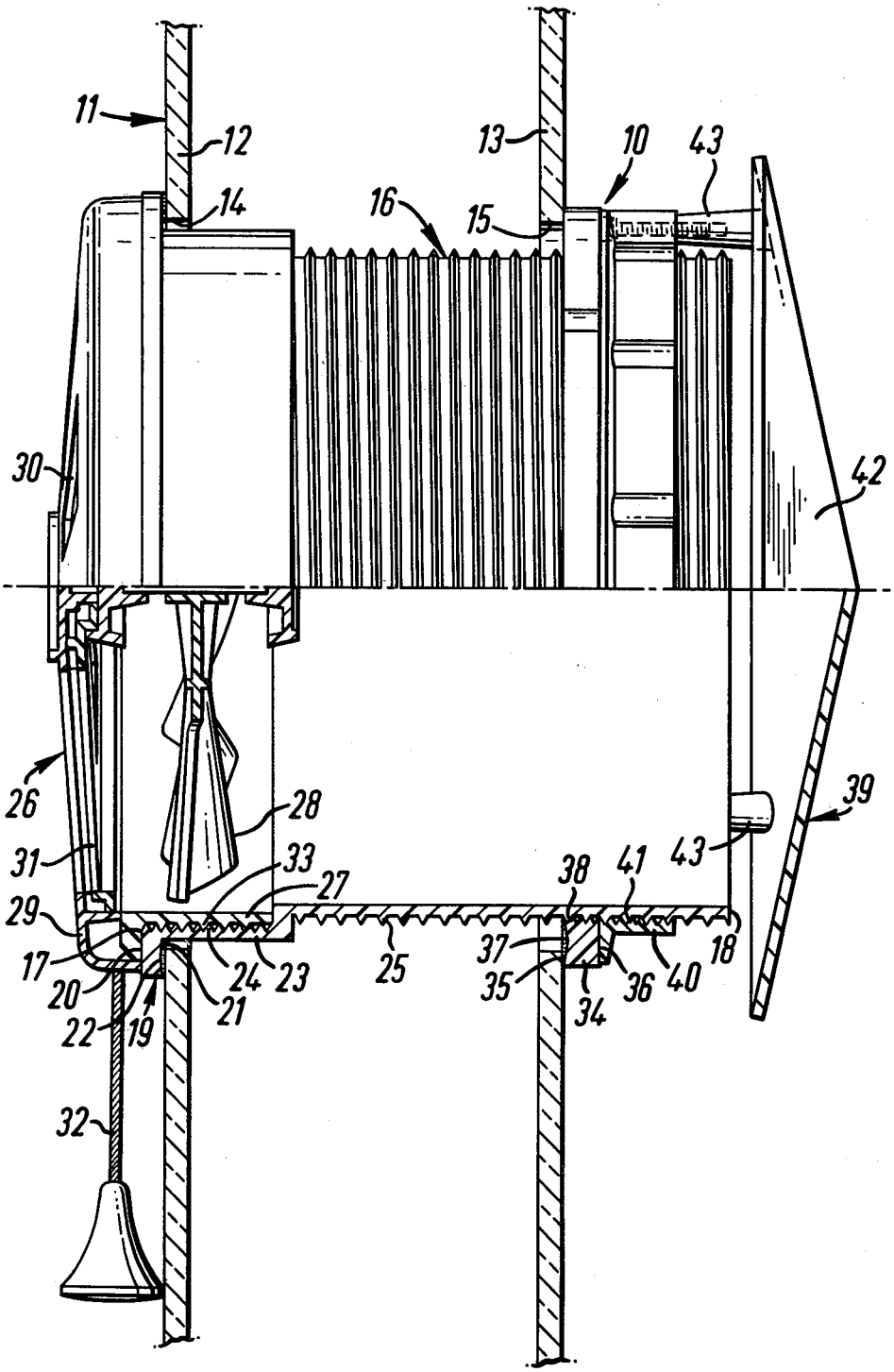
11
12
13
10
43
14
16
15
30
42
26
28
39
31
33
27
38
41
43
29
17
20
22
19
24
23
21
25
37
35
34
36
40
18
32

VENTILATION APPARATUS

This application is a continuation application of Ser. No. 319,937 filed Nov. 10, 1981 now abandoned.

BACKGROUND OF THE INVENTION

This invention relates to ventilating apparatus for exchanging air flow between an interior space and an exterior space.

It is known to provide ventilating apparatus for buildings. One type of ventilating apparatus is adapted to be mounted relative to a glazed panel of a building whereby air is exchanged between an interior space of the building and atmosphere outside the building. An aperture is provided in the glazed panel for receiving the ventilating apparatus. Generally, the apparatus comprises a cylindrical housing having an outwardly circumferentially extending flange and a fan rotatably mounted on a central longitudinal axis of the housing. The housing is provided with a shutter mechanism for controlling flow of air through the housing. The outer circumferential surface of the housing is provided with an axially extending thread adjacent the flange and is thereby adapted to co-operate with an annular member having an axially extending thread on an inner circumferential surface thereof.

The aperture is the glazed panel has a diameter greater than the external diameter of the cylindrical housing but less than the external diameter of the flange of the housing. The housing is inserted through the aperture so that a rear surface of the flange abuts an adjacent surface of the panel. The annular member then is mounted on a portion of the housing projecting from an opposite surface of the glazed panel and the annular member is screwed axially of the cylindrical member so that the flange of the housing and the annular member are secured in abutment with inner and outer surfaces respectively of the glazed panel.

Although such ventilating apparatus is suitable for use with a single glazed panel, the apparatus is not suitable for multi-glazed panels used in the building industry.

SUMMARY OF THE PRESENT INVENTION

According to the present invention, there is provided ventilating apparatus for exchanging air flow between an interior space and an exterior space comprising:

- a component having means for controlling air flow and
- a cylindrical member adapted to extend between a surface bounding the interior space and a surface bounding the exterior space, the component and the cylindrical member having interengagable formations
- so that the component is removably engagable with the cylindrical member whereby air flow controlled by the control means is guided through the cylindrical member.

The cylindrical member may be provided with means for locating the cylindrical member relative to the said surfaces.

The locating means may comprise a flange adapted to engage one of the said surfaces.

The cylindrical member may be provided with formations on an external circumferential surface thereof.

The locating means may further comprise an annular member having on an inner circumferential surface thereof formations complementary to the external surface of the cylindrical member whereby the annular member is adapted to be mounted on the cylindrical member so as to engage the other of the said surfaces.

The flange and the annular member may be adhesively secured to adjacent said surfaces.

The surface of the flange and the surface of the annular member adjacent the respective surfaces bounding the interior and exterior spaces may each be provided with a groove.

The cylindrical member may be provided with a portion of enlarged diameter for receiving the component.

The ventilating apparatus may be included in a building component containing said surfaces bounding the interior and exterior spaces.

Following is a description, by way of example only and with reference to the accompanying drawing, of one method of carrying the invention into effect.

DESCRIPTION OF THE DRAWING

The drawing is an elevation, shown partly in cross section, of ventilating apparatus in accordance with the present invention located in a sealed double glazed building component.

DESCRIPTION OF A PREFERRED EMBODIMENT

Referring to the drawing, there is shown ventilating apparatus 10 for use with a sealed double glazed building component 11 having spaced parallel glazed panels 12, 13. The panels 12, 13 are each provided with a circular aperture 14, 15.

The ventilating apparatus 10 comprises an elongate cylindrical member 16 of plastics material having an inner end wall 17 and an outer end wall 18. The cylindrical member 16 is provided with an outwardly, circumferentially extending flange 19 having an inner surface 20 contiguous with the inner end wall 17 of the cylindrical member 16 and an outer surface 21. The outer surface 21 of the flange 19 is provided with a circumferentially extending groove 22. The cylindrical member 16 is provided with a portion 23 of enlarged diameter extending axially away from the outer surface 21 of the flange 19. The enlarged diameter portion 23 is provided with an internal axially extending thread 24. The portion of the cylindrical member 16 between the enlarged portion 23 and the outer end wall 18 is provided with an outer axially extending thread 25.

The enlarged portion 23 of the cylindrical member 16 is adapted to receive a component 26 of plastics material. The component 26 comprises a cylindrical housing 27 in which is rotatably mounted on a central longitudinal axis thereof a fan 28 and a cowl 29 having apertures 30 therein and a shutter mechanism 31 for controlling flow of air through the apertures 30. The shutter mechanism 31 is provided with means 32 for operating the shutter mechanism 31. The housing 27 is provided on an outer circumferential surface thereof with an axially extending thread 33 complementary to the thread 24 on the enlarged portion 23.

The ventilating apparatus 10 also comprises an annular member 34 of plastics material. The annular member 34 has an inner surface 35 and an outer surface 36. The inner surface 35 is provided with a circumferentially extending groove 37. The annular member 34 has an internal axially extending thread 38 which is complementary to the external thread 25 of the cylindrical member 16.

The ventilating apparatus 10 may optionally comprise a store guard member 39 of plastics material comprising an annular member 40 having an axially extending internal thread 41 complementary to the external thread 25 of the cylindrical member 16 and a cowl 42 spaced axially from the annular member 40 by means of spacers 43.

The ventilating apparatus 10 is assembled in the component 11 by inserting the outer end wall 18 of the cylindrical member 16 through the apertures 14, 15 of the glazed panels 12, 13 so that the outer surface 21 of the flange 19 is adjacent an inner surface of the glazed panel 12, the portion of the cylindrical member 16 having the external thread thereon thereby extending through the aperture 15 in the glazed panel 13. The annular member 34 then is threaded onto the portion of the cylindrical member 16 extending outwardly beyond the glazed panel 13 and is screwed axially of the cylindrical member 16 towards the glazed panel 13. Adhesive then is applied between the outer surface 21 of the flange 19 and the adjacent surface of the glazed panel 12 and between the inner surface 35 of the annular member 34 and the adjacent surface of the glazed panel 13. The annular member 34 then is screwed further axially of the cylindrical member 16 towards the flange 19 thereof so that the glazed panel 12 is engaged by and adhesively secured to the outer surface 21 of the flange 19 and the glazed panel 13 is engaged by and adhesively secured to the inner surface 35 of the annular member 34. The cylindrical member 16 thus is secured in sealed engagement with the glazed panels 12, 13.

The cylindrical housing 27 of the component 26 then is screwed into the enlarged diameter portion 23 of the cylindrical member 16 and, if desired, the storm guard member 39 is located on the outer end portion of the cylindrical member 16 by locating the annular member 40 thereon and screwing the annular member 40 axially thereof towards the glazed panel 13.

It will be appreciated that the component 26 and the storm guard member 39 can be removed from the cylindrical member 16, for cleaning purposes for example, and replaced without breaking the seal between the glazed panels 12, 13. The seal being effected by means of the adhesive which is retained by the grooves 22 and 37.

It will also be appreciated that the ventilating apparatus 10 may be used with secondary double glazing panels whereby additional glazed panels are located adjacent existing glazed panels and apertures are provided in the glazed panels for receiving the ventilating apparatus.

Furthermore, it will be appreciated that the length of the cylindrical member 16 is such as to extend through apertures in multiple glazed panels and that an end portion of the cylindrical member 16 remote from the flange 19 may be severed after the ventilating apparatus has been mounted in position relative to glazed panels.

It will also be appreciated that the component 26 may comprise an alternative unit having the fan 28 and the shutter mechanism 31 omitted. The alternative unit may further comprise a louvered panel replacing the cowl 29.

The invention is applicable to building components other than multiple glazed panel components and may, for example, be used in a building block having an aperture or apertures provided for receiving ventilating apparatus in accordance with the invention.

I claim:

1. Ventilating apparatus (10) for transferring air from one to another of a pair of spaces that are separated by a pair of spaced apart substantially parallel fixed panels (12, 13), said panels having aligned apertures (14, 15) therein and a substantially inaccessible air space therebetween, said apparatus (10) comprising: a one-piece hollow cylindrical rigid member (16) receivable in said aligned apertures (14, 15) in said panels (12, 13) to extend through both of said apertures (14, 15) and across said air space between said panels (12, 13), said cylindrical rigid member (16) having an external surface and an internal surface, said external surface comprising an external first screw thread (25) that extends along at least a part of the length of said cylindrical rigid member (16) from one end thereof, said internal surface comprising an internal second screw thread (24) that extends along at least a part of the length of said cylindrical rigid member (16) from the other end thereof, and said cylindrical rigid member (16) having near its said other end a radially outwardly projecting circumferential flange (19) for sealing engagement with the outer side of one (12) of said panels to prevent air flow between said cylindrical rigid member (16) and an edge of the aperture (14) in said one panel (12); a rotatable annular member (34) having an inner surface formed as a third screw thread (38) complementary to and engageable with said external first screw thread (25) and axially adjustable by rotation on said cylindrical rigid member (16) for sealing engagement with the outer side of the other (13) of said panels to prevent air flow between said cylindrical rigid member (16) and an edge of the aperture (15) in said other panel (13) and cooperable with said flange (19) for securing the cylindrical rigid member (16) against displacement relative to said panels (12, 13); an air flow controlling component (26) comprising a housing (27) and having means (28, 29, 30, 31) on said housing (27) for controlling air flow through said hollow cylindrical rigid member (16), said housing (27) having a cylindrical external surface comprising an external fourth screw thread (33) that extends along at least a part of the length of said housing (27) and is complementary to and engageable with said internal second screw thread (24) in the cylindrical rigid member (16) whereby said component (26) is removably received in said cylindrical rigid member (16) near said other end thereof, and means on said housing (27) engageable with said cylindrical rigid member (16) to limit the extent to which said housing (27) is insertable into said cylindrical rigid member (16), said part of said cylindrical rigid member (16) along which said internal second screw thread (24) extends has a larger inside diameter than the remainder thereof, adhesive sealing means for disposition between said flange (19) and said one panel (12) and between said annular member (34) and said other panel (13), said means for controlling air flow comprises a fan (28) and a shutter mechanism (31) mounted on said housing (27).

2. The ventilating apparatus (10) of claim 1 further including a storm guard (39) comprising an internally threaded second annular member (40) threadedly and removably engageable with said external first screw thread (25) on said one end of said cylindrical rigid member (16) and a cowl (42) connected to said second annular member (40).

* * * * *